United States Patent [19]

Bennett

[11] 4,146,952

[45] Apr. 3, 1979

[54] METHOD FOR THE INSULATION OF A TANK

[75] Inventor: Robert B. Bennett, Hebron, Ohio

[73] Assignee: The Dow Chemical Company, Midland, Mich.

[21] Appl. No.: 813,148

[22] Filed: Jul. 5, 1977

[51] Int. Cl.[2] ..... B23P 11/02

[52] U.S. Cl. ..... 29/452; 29/455 R; 29/526 R; 220/452; 52/248; 52/521

[58] Field of Search ..... 220/9 A, 9 F, 9 LG, 220/10, 15, 63 R; 52/248, 249, 269, 521, 741; 29/526, 452, 455

[56] References Cited

U.S. PATENT DOCUMENTS

| | | | |
|---|---|---|---|
| 553,319 | 1/1896 | Rose | 220/9 A UX |
| 602,454 | 4/1898 | Kelly | 220/9 A |
| 1,251,830 | 1/1918 | Siegfried | 220/9 A |
| 2,933,917 | 4/1960 | Sampson | 52/249 |
| 3,948,412 | 4/1976 | Bennett | 220/15 |
| 3,987,925 | 10/1976 | Sattelberg | 220/9 LG |
| 4,062,468 | 12/1977 | Bongiovanni | 220/9 A |

FOREIGN PATENT DOCUMENTS

| | | | |
|---|---|---|---|
| 234484 | 7/1961 | Australia | 220/9 LG |
| 1406910 | 9/1975 | United Kingdom | 220/9 A |

*Primary Examiner*—Charlie T. Moon

[57] ABSTRACT

A generally cylindrical tank is insulated by affixing thermal insulation panels on the side walls thereof using generally helically disposed tension elements such as wire to maintain the panels in position at least during installation.

4 Claims, 5 Drawing Figures

METHOD FOR THE INSULATION OF A TANK

It is often desired to thermally insulate generally cylindrical tanks or containers which have outer convex curved surfaces. Oftentimes, when residual oils or other materials, which become viscous or solid on cooling below a given temperature, must be heated during cold weather. It is frequently desired to insulate such tanks to prevent solidification of the contents or to maintain the contents at a desirably low viscosity. In view of the energy crisis, insulation has become particularly desirable and economically feasible for such installations. Tanks have been insulated by passing exterior tension bands about the insulation to maintain it against a tank. In my earlier patent, U.S. Pat. No. 3,948,412, I disclosed the use of welded studs to maintain insulating panels in place on the exterior surface of a tank, which overcomes some of the problems encountered with exterior banding. In some instances, it is undesirable and unsafe to employ welding methods to affix insulating panels to an existing tank which may either contain or be in the vicinity of flammable liquids, gases or solids. My U.S. Pat. No. 4,004,394 discloses a method of holding insulating panels to a tank utilizing circumferentially disposed bands adjacent the tank, the panels being held in position by means of clips passing under the straps or bands. Frequently, in the insulation of tanks of substantial size, positioning the circumferential bands and tightening of the bands can be inconvenient and time consuming. Such a technique generally requires the use of custom-fabricated hardware such as bands, connectors and the like.

It would be desirable if there were available an improved method for the installation of insulating panels on the generally cylindrical surfaces of cylindrical tanks.

It would be desirable if there were available an improved method for the installation of insulating panels on the generally cylindrical surfaces of cylindrical tanks that employed at least readily available materials.

It would also be desirable if there were available an improved insulated tank requiring minimal quantity of special components and labor.

These benefits and other advantages in accordance with the present invention are achieved in a method for affixing a plurality of insulating panels to an external cylindrical surface of a generally cylindrical tank, the tank having a top and a bottom and a generally cylindrical side wall, the steps of the method comprising disposing at least a first plurality of tensioned elongate tension members about the cylindrical wall of the tank and external to the tank, the tension members extending from a location adjacent the top of the tank to the bottom of the tank, the tension members being in generally spaced-apart relationship to each other and at least for a major portion of their length being generally helically disposed on the surface of the tank, applying insulating panels to the external surface of the tank by positioning panels in a desired location and affixing the panels to the generally helically disposed tension members.

Also contemplated within the scope of the present invention is an improved thermally insulated tank, the tank being of generally cylindrical configuration having a top, a bottom, and a generally cylindrical side wall, a plurality of elongate tension members in generally spaced relationship, extending from a location generally at the top of the tank to a location generally at the bottom of the tank, the tension members being generally disposed against the outer surface of the generally cylindrical tank wall, the tension members being generally helically disposed, a plurality of insulating panels disposed about the tank wall, the panels being affixed at least to the first plurality of tension members.

Further features and advantages of the present invention will become more apparent from the following specification taken in connection with the drawing wherein:

FIG. 1 schematically depicts a partially insulated tank in accordance with the invention;

Figure 1:
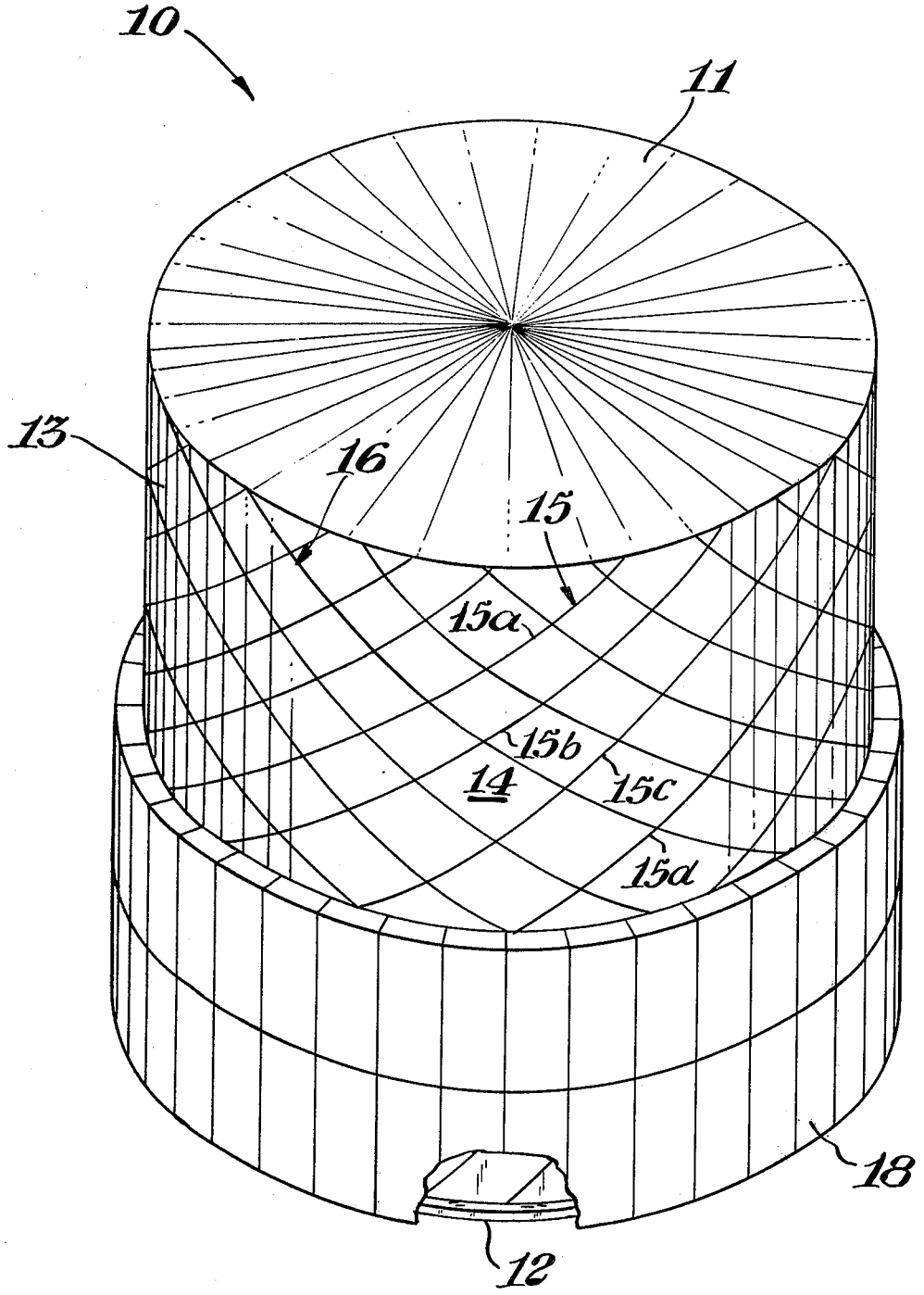

In FIG. 1 there is schematically depicted a partially insulated tank in accordance with the present invention generally designated by the reference numeral 10. The tank 10 comprises a top 11, a bottom 12 and a generally cylindrical side wall 13 having an external generally cylindrical surface 14. A first plurality of elongate tension members or wires 15 is disposed on the surface 14. The first plurality of wires 15 are in generally spaced-part parallel relationship and a portion of them are designated by the reference numerals 15*a*, 15*b*, 15*c* and 15*d*. The plurality of wires 15 extend entirely about the cylindrical wall 13 of the tank 10. The plurality of wires 15 are affixed to the tank adjacent the top 11 and adjacent the bottom 12 and have a generally helical configuration. A second plurality of elongate tension members or wires 16 is disposed on the cylindrical surface 14 of the side wall 13 of the tank 10. The plurality of wires 16 are affixed to the tank in a manner generally identical to the plurality 15, but the plurality 16 are disposed in a helix of opposite hand to the plurality 15. The plurality of generally rectangular insulating panels 18 are depicted disposed about the lowermost portion of the surface 14 of the tank wall 13. The panels 18 are affixed to wires to the first plurality 15 and second plurality 16 by means (not shown).

Figure 2:
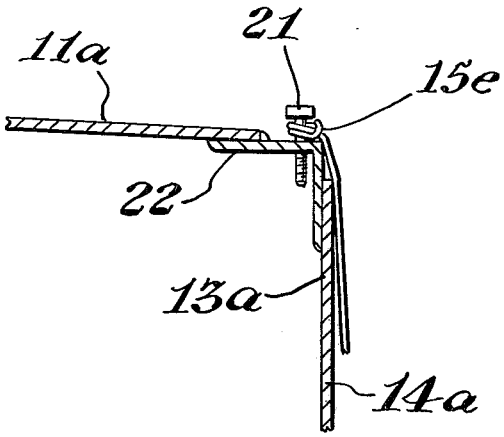
FIG. 2 is a schematic, sectional view of the mode of attachment of a tension member adjacent the top of the tank.

In FIG. 2 there is a schematic sectional view of an upper portion of a tank, the tank having a roof 11*a*, a cylindrical side wall 13*a* having an outer surface 14*a*. A self-drilling and self-tapping threaded fastener 21 passes through an angle member 22 which connects the wall 13*a* and the tank roof 11*a*. A wire 15*e* is twisted about the fastener 21.

Figure 3:
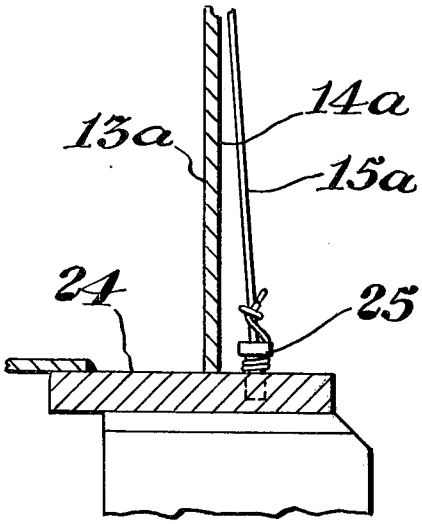
FIG. 3 is the schematic, sectional representation of the attachment of a tension member at the bottom of the tank.

In FIG. 3 there is depicted a sectional view of a base portion of a tank having a side wall 13*a* and a tank base 24. The wall 13*a* has an external surface 14*a*. A bolt 25 threadably engages the base 24 at a location adjacent the external surface 14*a* of the tank wall 13*a*. A wire 15*e* is wrapped about the bolt 25 and about itself to provide a secure connection.

Figure 4:
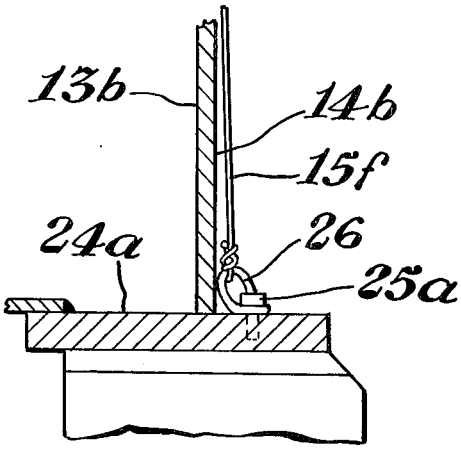
FIG. 4 depicts an alternate mode of attachment of a tension member.

In FIG. 4 there is depicted a sectional view of a tank having the base 24*a*, the generally cylindrical side wall 13*b* having an external surface 14*b*. A bolt 25*a* threadably engages the base 24*a* at a location adjacent the external surface 14*b* of the wall 13*b*. A wire attaching loop 26 is affixed to the base 24*a* by means of the bolt 25*a*. Beneficially, a loop such as the loop 26 is readily formed by bending a cold shut repair link sufficiently to permit passage of the bolt 25*a* through the hole in the cold shut. The embodiment depicted in FIG. 4 permits a tightening of a wire 15*f* more readily than the embodiment depicted in FIG. 3.

Figure 5:
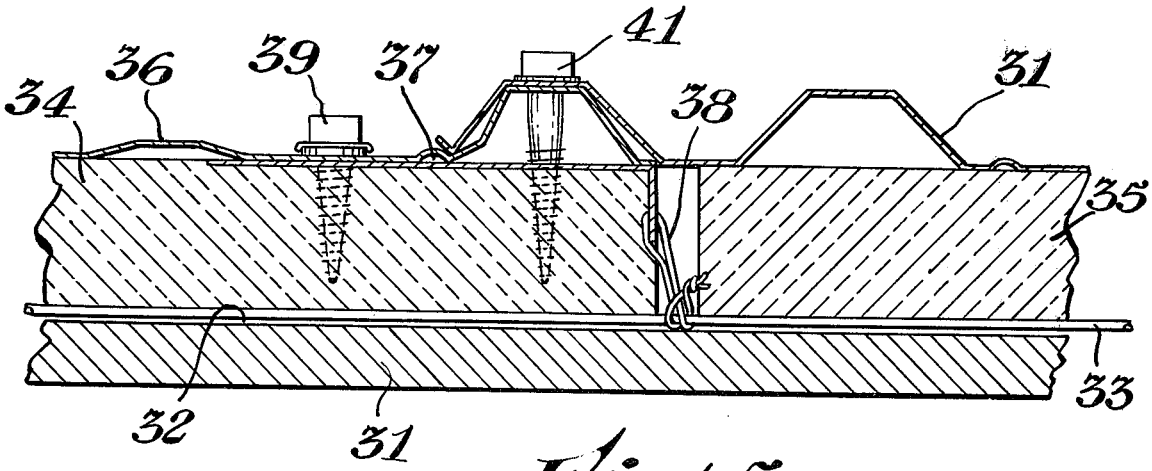
FIG. 5 is a schematic sectional representation of the attachment of a panel adjacent the cylindrical wall of a tank.

In FIG. 5 there is depicted a schematic sectional view of insulating panels installed on a tank in accordance with the present invention. A tank wall 31 has an external surface 32 having disposed thereon a tensioned, generally helically disposed wire 33 equivalent to the wires 15 and 16 of the previous illustrations. First and second insulation panels 34 and 35 are disposed generally adjacent the surface 32 of the tank wall 31 and the wire 33. The insulation panels 34 and 35 have corrugated metal facings 36 and 37, respectively. A panel attaching clip or bracket 37 whose thickness has been exaggerated for ease of illustration is disposed adjacent the external surface of the panel 34 adjacent one edge thereof. The clip 37 is of sheet metal and has a generally L-shaped configuration wherein the short leg of the "L" has one hole punched therein through which is passed a length of attaching wire 38. The wire 38 is looped through the clip 37, passed under the wire 33 and twisted to prevent further movement. The clip 37 is affixed to the panel facing 36 by means of a self-tapping fastener 39. The faces 36 and 31 of the panels 34 and 35 are joined by means of a second self-tapping fastener 41. On a completed installation, adjacent panel edges are joined, thus, in essence, anchoring each panel at both major edges and the panel to a wire at locations where one edge of the rectangular panel and a helically-disposed wire intersect.

Elongate tension members suitable for use in the present invention are readily prepared from a variety of materials. Steel strapping may be employed. Metal cable is also useful, however, smooth galvanized steel fence wire is employed with great benefit in that auxiliary fasteners generally are not required. Single strand fence wire is readily bent about itself and/or another piece of wire to provide a connection which is stronger than the breaking strength of the wire itself. Employing such smooth fence wire considerably reduces hardware requirements.

In preparing tanks in accordance with the present invention, generally it is desirable to first affix one end of the wire or tension member to the upper edge of the tank. This can be accomplished in the manner depicted in FIG. 2 or alternatively if an angle member such as the angle member 22 projects outwardly rather than inwardly a circumferential flange is available at the upper portion of the tank. The flange can be drilled or punched. An eyebolt is connected to one end of the tension member and the wire or tension member raised to the top edge of the tank and the eyebolt affixed to the flange through the appropriate hold provided. The lower end of the wire is then positioned near its lower anchor and tensioned by means of a fence stretcher, ratchet hoist or similar pulling tool. When the desired amount of tension has been provided, the member is then anchored to the lowermost position. The procedure is then repeated until the desired number of tension members have been installed on the tank. Advantageously, hard drawn galvanized steel wire is usually preferred. If necessary, a second set of tension members equivalent to members 16 may be installed in a similar manner. If two sets of tension members are desired, one may connect two tension members, one from each set and simultaneously install both sets in the manner hereinbefore described. If any particular installation, corrosion will be a problem, bolts and other connectors desirably are covered with a caulking composition or corrosion-resistant coating such as paint. Generally, such tension members are installed in such a manner that they are at an angle from the vertical of from about 20 to 65° and beneficially from about 35 to 50° and desirably at 45° plus or minus 5°. The spacing of tension members will be dependent upon the size of the panels being installed and the weight of the panels. Beneficially, when installing panels which are about 4 ft by 8 ft, the tension members or wires are spaced on about 3 ft horizontal centers, assuming the panel is of plastic foam and has a sheet metal face. When installed, the tension members have a generally helical configuration and for most of their length are drawn against the surface of the structure being insulated. Once sufficient tension members have been provided, panels are readily installed from the bottom up on the tank. Generally, when installing foam insulating panels, the portion of the tension member adjacent the bottom of the tank which is spaced from the tank may readily be inserted into a groove cut in the rear surface of the panel to avoid having the bottom panels spaced from the tank wall. In installing panels such as are depicted in FIG. 5, a short piece of wire is passed through a hole in the short leg of the panel clip 37, the panel clip forced below the facing sheet 36 between the insulating material and the facing sheet and the clip is anchored in place by means of the screw or bolt 39. Beneficially, the tension member is stretched slightly and spaced from the tank at a location where it is to be connected to the panel. This generally can be accomplished by placing an appropriate prying instrument beneath the tension member to space it from the tank. A wedge, chisel, floor chisel or claw hammer may be employed with great convenience when fence wire is utilized for the tension members. The panel is then placed in position against the tank and the short length of wire from the clip is passed underneath the tension member such as the member 33. Conveniently, each end of the wire passing through the clip is passed under the wire from opposite sides, then grasping both ends of the short length of wire passing through the clip 37. The panel is pulled against the tension member 33 and both ends of the wire are twisted to prevent any further movement of the wire. Beneficially, wire for securing panels to the tension member may be a small gauge stainless steel wire, for example, 18 gauge (0.0475 inch) stainless steel. A second edge of the panel is secured in a like manner. The second and subsequent panels are then installed by placing the second panel in edge-to-edge abutting relationship with the first panel, connecting the facing sheets as depicted in FIG. 5 with screw fasteners such as the screw 41. The remaining edge of the panel is then affixed to the tension member in the hereinbefore described manner and the process repeated until the desired portion of the cylindrical surface of the tank has been insulated.

Although the foregoing procedure has been described particularly for foam plastic panels having a metallic face, the procedure of the present invention is readily adaptable to supporting a wide variety of insulating panels on a generally cylindrical surface.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

I claim:

1. A method for affixing a plurality of insulating panels to an external cylindrical surface of a generally cylindrical tank, the tank having a top and a bottom and a generally cylindrical side wall, the steps of the method comprising disposing at least a first plurality of tensioned elongate tension members about the cylindrical wall of the tank and external to the tank, the tension members extending from a location adjacent the top of the tank to the bottom of the tank, the tension members being in generally spaced-part relationship to each other and for at least a major portion of their length being generally helically disposed on the surface of the tank, applying insulating panels to the helically disposed tension members and the external surface of the tank by positioning panels in a desired location and affixing the panels to the generally helically disposed tension members.

2. The method of claim 1 wherein the elongate tension members are wires.

3. The method of claim 2 including the step of affixing the panels to the tension members by means of short lengths of wire.

4. The method of claim 3 including the step of affixing a sheet metal clip to the panel and affixing the clip to an adjacent tension member.

* * * * *